United States Patent [19]

Luke et al.

[11] Patent Number: 4,492,396

[45] Date of Patent: Jan. 8, 1985

[54] ONE-PIECE, SLAM-TYPE LATCH FOR SNAP-IN INSTALLATION

[75] Inventors: Roger D. Luke, Clifton Park, N.Y.; Wayne A. Ingram, Stone Mountain; Michael S. Jarrell, Decatur, both of Ga.

[73] Assignee: Siemens-Allis, Inc., Atlanta, Ga.

[21] Appl. No.: 315,773

[22] Filed: Oct. 28, 1981

[51] Int. Cl.[3] ..... E05C 3/14

[52] U.S. Cl. ..... 292/228; 292/DIG. 31; 292/DIG. 38

[58] Field of Search ..... 292/DIG. 38, DIG. 31, 292/228, 87, 246, 128, 80, 85, DIG. 71, 347; 361/356–358

[56] References Cited

U.S. PATENT DOCUMENTS

| | | | |
|---|---|---|---|
| 404,872 | 6/1889 | Scofield . | |
| 2,221,532 | 11/1940 | Westerheim | 292/228 X |
| 2,823,940 | 2/1958 | Squire . | |
| 2,947,559 | 8/1960 | Olsson | 292/128 |
| 3,161,923 | 12/1964 | Crain . | |
| 3,208,781 | 9/1965 | Appleberry | 292/228 X |
| 3,266,830 | 8/1966 | Appleberry . | |
| 3,323,676 | 6/1967 | Poittevin | 292/128 X |
| 3,334,770 | 8/1967 | Stanback | 292/87 X |
| 3,652,113 | 3/1972 | Odend'hal et al. | 292/DIG. 71 X |
| 3,709,538 | 1/1973 | Seitz et al. . | |
| 3,797,870 | 3/1974 | Beckman . | |
| 3,806,173 | 4/1974 | Sweda . | |
| 3,850,464 | 11/1974 | Bisbing et al. . | |
| 3,907,346 | 9/1975 | Van Klompenburg | 292/DIG. 38 X |
| 3,985,380 | 10/1976 | Raivio . | |
| 4,293,153 | 10/1981 | Stanback et al. | 292/85 |

FOREIGN PATENT DOCUMENTS

| | | | |
|---|---|---|---|
| 1027555 | 4/1958 | Fed. Rep. of Germany | 292/128 |
| 2634815 | 2/1978 | Fed. Rep. of Germany | 292/128 |

*Primary Examiner*—Gary L. Smith
*Assistant Examiner*—Russell W. Illich
*Attorney, Agent, or Firm*—F. W. Powers; J. L. James

[57] ABSTRACT

A one-piece, slam-type latch for snap-in installation in an orifice of a door is provided for maintaining the door in a closed position relative to a door frame having an extending keeper means. The latch includes a first portion having a generally rectangular configuration, and a second portion extending normally outward from the first portion for insertion through the orifice. One end of the second portion is in integral attachment with one side of the first portion. The other end of the second portion is provided with at least one indentation for interlocking engagement with the keeper means. A leaf spring is integrally attached to the second portion and extends angularly from the second portion toward the first portion. The latch is further provided with a third portion in integral engagement with the first and second portions. The third portion extends planarly outward from the first portion. The third portion has an auriculate recess provided with a first lobe extending inwardly toward the first portion and a second lobe extending planarly opposite the first lobe to define a thin-walled section of the third portion. The thin-walled section of the third portion is sufficiently pliable so that the third portion may be deformed.

13 Claims, 4 Drawing Figures

ONE-PIECE, SLAM-TYPE LATCH FOR SNAP-IN INSTALLATION

BACKGROUND OF THE INVENTION

A. Field of the Invention

The present invention relates generally to latches and more particularly to one-piece, slam-type latches for snap-in installation in a pivotal door.

B. Description of the Prior Art

Those concerned with maintaining a door panel, especially a hinged door panel in a closed position frequently use slam-type, snap-in type latches because of their ease in installation and operation. One such latch is described in U.S. Pat. No. 3,850,464 to Bisbing et al. The latch described therein operates by spring-biased sliding action to engage the door frame or striker plate. In one form of this type of latch, the spring-bias action is provided by the resilience of the plastic material of which the latch is made. The latch may be inserted through a relatively large orifice in the door panel. To release the latch from the striker plate or door frame, pressure is applied to the latch to slide the latch from one end of the relatively large orifice to the other to an unlatched position. One disadvantage of the latch described in the Bisbing et al. reference is that a relatively large orifice is required for insertion of the latch through the door. This is undesirable in instances in which explosive forces may be created in the area enclosed by the door, for example, in an electric fuse box or panelboard. Under such circumstances, a relatively large orifice in the door is undesirable because it allows explosive forces to act on a major portion of the latch, and may undesirably cause the latch to move from the closed to the open position when such explosive forces are present.

SUMMARY OF THE INVENTION

In view of the foregoing, one object of the subject invention is to provide a latch which requires a relatively small orifice for insertion through a door to expose a minimum surface area of the latch to explosive forces in the event of an explosion on the inside of the door.

Another object of the subject development is to provide a latch which engages a keeper means in a door in such a way so as to enhance the engagement action of the latch in the event of an explosion.

Another object of the subject development is to provide a relatively inexpensive latch when manufactured on a large scale.

Still another object of the invention is to provide a latch which may be easily inserted into an appropriately sized orifice and easily operated to disengage from a keeper means under appropriate circumstances.

Other objects, advantages, and novel features of the present invention will become apparent from the following detailed description of the invention when considered in conjuction with the accompanying drawings.

A one-piece, slam-type latch for snap-in installation in an orifice of a door is provided for maintaining the door in a closed position relative to a door frame having an extending keeper means. The latch includes a first portion having a generally planar rectangular configuration, and a second portion extending normally outward from the first portion for insertion through the orifice. One end of the second portion is in integral attachment with one side of the first portion. The other end of the second portion is provided with a means for cooperating with the keeper means for increasing resistance against pivotal movement of the door when the door is subjected to increases in pressure on its inner side. The cooperating means may include at least one indentation for interlocking engagement with the keeper means. A leaf spring is integrally attached to the second portion and extends angularly from the second portion toward the first portion. The latch is further provided with a third portion in integral engagement with the first and second portions. The third portion extends planarly outward from the first portion. The third portion has an auriculate recess provided with a first lobe extending inwardly toward the first portion and a second lobe extending planarly opposite the first lobe to define a thin-walled section of the third portion. The thin-walled section of the third portion is sufficiently pliable so that the third portion may be deformed.

DETAILED DESCRIPTION OF THE PREFERRED EMBODIMENT

Figure 1:
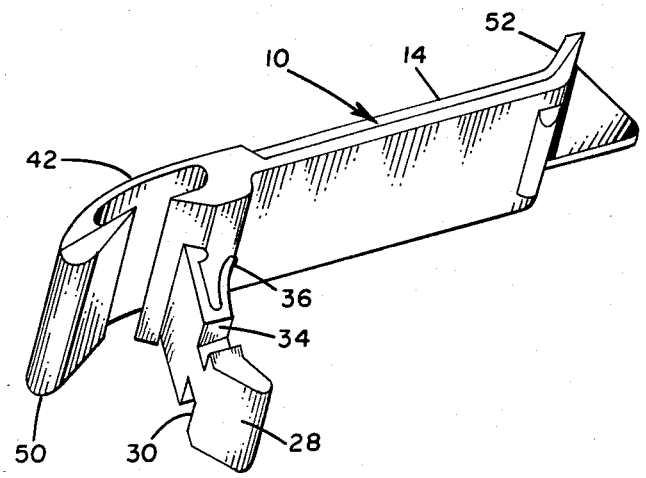
FIG. 1 is an isometric view of one embodiment of the subject latch.
Figure 2:
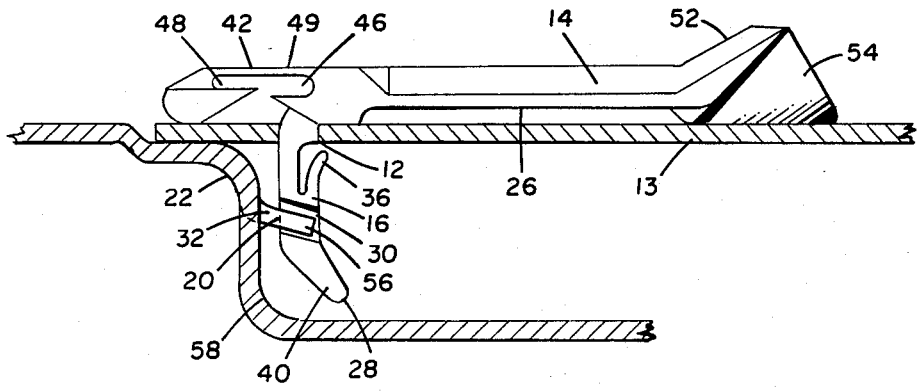
FIG. 2 is a side view of one embodiment of the subject latch in a door frame.

A one-piece, slam-type latch generally designated as 10, FIG. 1, is provided for installation in an orifice 12, FIG. 2, of a pivotal door 13. A first portion 14 of the latch may be positioned parallel to the outer surface of the door while a second portion 16 extends through the orifice 12 of the door panel. The second portion is provided with a means for interlocking engagement with a keeper means 20 of a door frame 22 of an electric panelboard.

In the preferred embodiment, the first portion 14 has a generally rectangular configuration which may be maintained in semiflush position against the outer surface of the door 13 of the electric panelboard.

Figure 4:
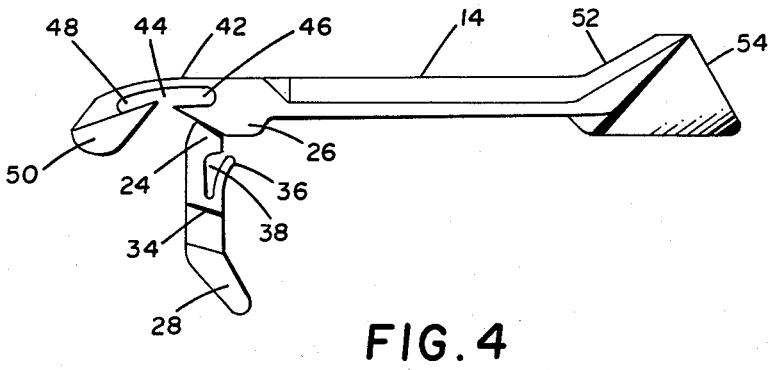
FIG. 4 is a side view of the preferred embodiment of the subject latch.

The second portion 16 extends normally outward from the first portion 14 for insertion through the orifice 12 of the door 13. One end 24, FIG. 4, of the second portion is in integral attachment with on end 26 of the first portion. The other end 28 of the second portion 16 is provided with at least one indentation 30 for interlocking engagement with an engagement tab 32 extending outwardly from the door frame 22. In the preferred embodiment, the engagement tab is angled away from the door as illustrated in FIG. 2. Two indentations 30, 34 may be provided in the second portion 16 for interlocking engagement with a bifurcated engagement tab 32 which forms the keeper means 20. Each indentation 30, 34 may have a generally rectangular configuration and may extend from either side of one end 28 of the second portion 16. The subject invention comprehends that in the preferred embodiment the indentations, 30, 34 may have an angular parallelepiped configuration, as illustrated in FIG. 4. As will be seen from the accompanying drawings, such an angular configuration causes the engagement of the interlocking means with the keeper means to increase with increases in pressure on the inner side of the door.

The subject invention comprehends that a leaf spring 36 is integrally attached to the second portion 16 and extends angularly from the second portion 16 toward the first portion 14. The leaf spring serves to prevent removal of the second portion 16 from the orifice 12 once the second portion 16 has been inserted through the orifice 12. The leaf spring 36 is disposed on the second portion 16 between the keeper means 20 and the first portion 14. A recess 38, FIG. 4, may be provided in the second portion 16 adjacent to the leaf spring 36 to provide flexibility in the second portion 16 and to simplify manufacture of the leaf spring 36. The second portion 16 may be further provided with a camming surface 40 adjacent to the interlocking means to contact the keeper means 20 of the door frame 22 as the door 13 is pivoted to a closed position. In the preferred embodiment, the camming surface 40 extends from one end 28 of the second portion 16. The camming surface 40 in the preferred embodiment extends angularly from the second portion at an angle of 45°. Of course, it would be obvious to one skilled in the art that other angles could be used.

The subject invention comprehends that the latch 10 is provided with a third portion 42 in integral engagement with the first and second portions 14, 16 respectively. The third portion, in the preferred embodiment, is provided with an auriculate recess 44 on the side of the third portion in semiflush position with the door 13. The recess 44, in the preferred embodiment, includes a first lobe 46 extending inwardly toward the first portion 14. A second lobe 48 is provided in the auriculate recess in the preferred embodiment extending planarly opposite the first lobe 46. The recess 44 defines a thin-walled section 49 of the third portion 42 that is sufficiently pliable to allow the third portion to be deformed.

The third portion may include a curved nub 50 at the outer end of the third portion 42 extending toward the second portion 16 to provide a bending surface and to promote deformation of the thin-walled section 49. Nub 50 may also act as a biasing means to maintain the latch 10 in a semiflush position against the door 13.

The subject invention further comprehends that the latch 10 may further include a fourth portion 52 integrally attached to one side of the first portion 14 opposite the side that the second and third portions 16, 42, respectively, are attached to. The fourth portion extends angularly outward from the first portion 14 away from the second portion 16. The subject invention comprehends that the fourth portion has dimensions to allow at least one finger of a latch operator to be placed between the door 13 and the fourth portion 52 when the second portion 16 is inserted through the door orifice 12. In the preferred embodiment, the fourth portion 52 extends angularly outward from the second portion 14 at an angle of 60°. Of course, it would be obvious to one skilled in the art that other angles could be used.

The subject invention further comprehends that the fourth portion may include a normally extending generally triangular protrusion 54 disposed midway along one side of the fourth portion so that the protrusion 54 extends from one end of the fourth portion attached to the first portion to the opposite end of the fourth portion. When the latch 10 is placed in position through the orifice 12, the protrusion 54 is in juxtaposition with the door 13. Protrusion 54 serves a further purpose of preventing accidental opening of the door in instances when someone brushes by the latch. Since the protrusion 54 extends to a position flush with the door 13, it is less likely that a passerby would accidentally "catch" the latch and open the door.

The subject invention comprehends that the subject latch may be formed of a relatively stiff material that is capable of resilient deformation such as Zytel 101L, a registered trademark of E. I. duPont de Nemours & Company.

Figure 3:
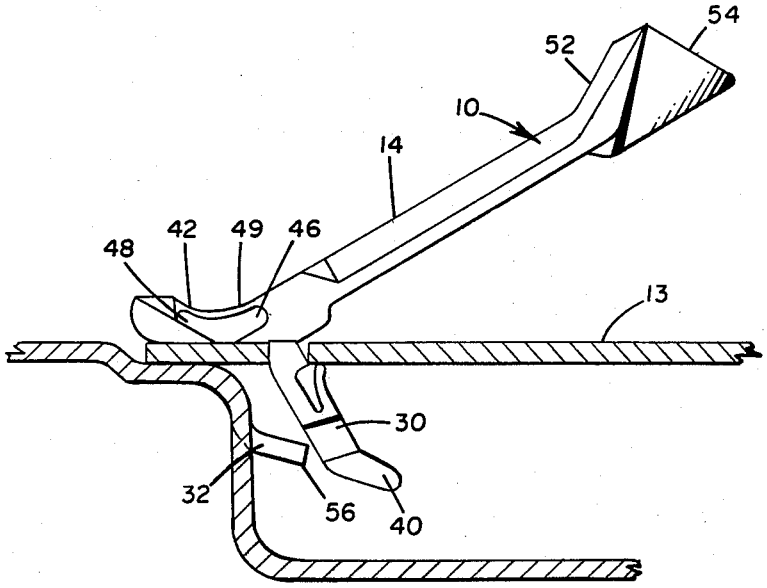
FIG. 3 illustrates the operation of the subject latch.

Referring now to FIG. 3, operation of the latch 10 is very simple. The latch 10 may be snapped in place through an appropriately sized orifice 12 in a door 13. Once the second portion 16 of the latch has been inserted through the orifice 12, the leaf spring 36 serves to prevent removal of the second portion 16 of the latch from the orifice 12. To close the door 13 with the latch 10 in place, all that is required is to simply slam the door shut. In slamming the door, camming surface 40 contacts an outer portion 56 of engagement tab 32 to cause the thin-walled section 49 of the third portion 42 to deform. The first portion 14 of the latch is resultingly lifted away from the outer surface of the door 13, thus deflecting the second portion 16 of the latch away from the outer portion 56 of the keeper means or engagement tab. The outer portion 56 of the engagement tab 32 will travel along camming surface 40 until engagement of tab 32 with indentation 30 occurs. Once the outer portion 56 of the engagement tab 32 engages indentation 30, the thin-walled section 49 of the third portion 42 returns to its normal, undeformed state, thus allowing the first portion 14 of the latch to return to a normal position parallel to the outer surface of the door 13.

As can be seen in FIG. 2, in the event of an explosion behind the door 13, only a relatively small portion of the latch 10 is exposed to explosive forces. Increases in pressure against the inside of the door 13 cause engagement between tab 32 and the latch to increase because the angular position of the indentations with respect to the door causes the engagement means of the latch to advance toward the side wall of the panel box. Thus, engagement of the engagement tab 32 with indentation 30 greatly counteracts forces acting on the inside of the door to open the door.

To open the door from the outside, it is necessary to apply pressure to either the first or fourth portion 14, 52, respectively, to lift the first portion away from the door to resultingly deform the thin-walled section 49. Deformation of the thin-walled section 49, as previously discussed, causes the second portion 16 to pivot outward away from the keeper means 20 to disengage engagement tab 32 from indentation 30. A first angular nib portion extending from lobe 46 prevents excessive deformation of the thin-walled section of the latch away from the door. The first angular nib together with a second angular nib extending from lobe 48 further serve to partially fill the auriculate recess when the latch is in the normally closed position with respect to the door to prevent unauthorized use of the recess to hang a coat hanger, etc. thereupon.

One advantage of the subject latch over prior art one-piece, snap-in type latches is that the subject latch requires a relatively small orifice to insert the latch through a door; and thus a relatively small area of the latch is exposed to explosive forces in the event of an explosion on the inside of the door.

Another advantage of the subject latch over prior art latches is that the portion of the latch which engages a keeper means in the door is designed so as to enhance the engagement action of the latch in the event of an explosion.

Yet another advantage of the subject development is that the subject latch has a relatively simple design to manufacture and is relatively inexpensive to produce on a large scale due to its unique one-piece design.

Still another advantage of the invention over the prior art is that the subject latch is designed to be easily inserted into an appropriately sized orifice and easily operated to disengage from a keeper means under appropriate circumstances.

Although the invention has been described and illustrated in detail, it is to be clearly understood that the same is by way of illustration and exanple only, and is not to be taken by way of limitation, the spirit and scope of this invention being limited only by the terms of the appended claims.

We claim:

1. A one-piece, slam-type latch for snap-in installation in an orifice provided in a pivotal door for maintaining the door in a closed position relative to a door frame having keeper means extending from the inner side of said door frame, comprising:

a first portion for placement on an outer surface of said door;

a second portion extending outward from said first portion for insertion through said orifice, said second portion being in integral attachment with one side of said first portion;

a third portion in integral engagement with said second portion and substantially coplanar with the first portion, said third portion having a thin-walled section being sufficiently flexible to allow said third portion to be deformed;

means on said second portion, cooperating with said keeper means for increasiong resistance against pivotal movement of said door with increases in pressure on the inside of the door; and a fourth portion integrally attached to one end of said first portion opposite the end that said second and third portions are attached to, said fourth portion extending angularly outward from said first portion away from said second portion, said fourth portion having sufficient dimensions to allow at least one finger of a latch operator to be placed between said door and said fourth portion when said second portion is inserted through said orifice, said second portion having a camming surface extending from one end of said second portion opposite the end of said second portion attached to said first portion, said camming surface extending angularly toward said fourth portion, said camming surface being provided to contact said keeper means of said door frame to cause said flexible thin-walled section of said third portion to deform as said door is closed when said second portion is inserted through said orifice, said thin-walled section being provided with an angular nib for prevention of excessive deformation of said thin-walled section.

2. The latch as recited in claim 1, wherein said camming surface extends angularly from said second portion at an angle of 45°.

3. An electric panelboard having a one-piece, slam-type latch for snap-in installation and an orifice provided in a pivotal door on said panelboard for maintaining the door in a closed position relative to a door frame having a keeper means extending from the inner side of said door, comprising:

a first portion for placement on an outer surface of said door, a second portion extending outward from said first portion for insertion through said orifice, said second portion being in integral attachment with one side of said first portion;

a third portion in integral engagement with said second portion and substantially coplanar with the first portion, said third portion having a thin-walled section being sufficiently flexible to allow said third portion to be deformed; and means on said second portion, cooperating with said keeper means for increasing resistance against pivotal movement of said door with increases in pressure on the inside of the door.

4. A one-piece, slam-type latch for snap-in installation in an orifice provided in a pivotal door for maintaining the door in a closed position relative to a door frame having keeper means extending from the inner side of said door frame, comprising:

a first portion for placement on an outer surface of said door;

a second portion extending from said first portion for insertion through said orifice and engaging said keeper means in the installed position on the closed door;

a third portion in integral engagement with said first and second portions and substantially coplanar with the first portion, said third portion having a thin-walled section being sufficiently flexible to allow said third portion to be deformed, said second portion moving out of engagement with the keeper means in response to deformation of the third portion;

means on said second portion, cooperating with said keeper means for increasing resistance against pivotal movement of said door with increases in pressure on the inside of the door; and a leaf spring integrally attached to said second portion toward said first portion to prevent removal of said second portion from said orifice once said second portion has been inserted in said orifice.

5. The latch as recited in claim 4, wherein said means for increasing resistance against pivoting of said door includes means for interlocking engagement with said keeper means having two indentations, each indentation being diposed on opposite sides of said second portion.

6. The latch as recited in claim 5, wherein said indentations are angularly disposed to cause engagement with said keeper means to increase when said door is exposed to explosive forces on the inner side of said door.

7. The latch as recited in claim 4, wherein said second portion is further provided with a camming surface extending from one end of said second portion opposite an end of said second portion attached to said first portion, said camming surface being provided to contact said keeper means of said door frame to cause said flexible thin-walled section of said third portion to deform as said door is closed when said second portion is inserted through said orifice, said thin-walled section being provided with an angular nib for prevention of excessive deformation of said thin-walled section.

8. The latch as recited in claim 4, wherein the latch is formed of Zytel 101L.

9. The latch as described in claim 4, wherein said first portion is substantially planar and parallel to the outer surface of said door, and wherein said second portion extends substantially normally outward from said frist portion.

10. The latch as recited in claim 4, wherein said fourth portion extends angularly outward from said first portion at an angle of 60°.

11. The latch as recited in claim 10, wherein said fourth portion further includes a normally extending generally triangular protrusion disposed midway along one side of said fourth portion from the end of said fourth portion attached to said first portion and the opposite end of said fourth portion.

12. The latch as recited in claim 4, wherein said means for increasing resistance against pivoting of said door includes means for interlocking engagement with said keeper means having two indentations, each indentation being disposed on opposite sides of said second portion.

13. The latch as recited in claim 12, wherein said indentations are angularly disposed to cause engagement with said keeper means to increase when said door is exposed to explosive forces on the inner side of said door.

* * * * *